United States Patent [19]

Dawson et al.

[11] 4,086,086

[45] Apr. 25, 1978

[54] CAST IRON

[75] Inventors: John Victor Dawson, Stratford-upon-Avon, England; Michael John Lalich, Downington, Pa.

[73] Assignee: British Cast Iron Research Association, Birmingham, England

[21] Appl. No.: 765,394

[22] Filed: Feb. 3, 1977

[30] Foreign Application Priority Data

Feb. 10, 1976 United Kingdom ..... 05083/76

[51] Int. Cl.[2] ..... C22C 33/08; C22C 33/00

[52] U.S. Cl. ..... 75/130 R; 75/123 E; 75/123 L; 75/130 AB; 75/134 S

[58] Field of Search ..... 75/130 R, 130 AB, 134 S, 75/123 E, 123 L

[56] References Cited

U.S. PATENT DOCUMENTS

| | | | |
|---|---|---|---|
| 2,837,422 | 6/1958 | Motz | 75/130 AB |
| 3,146,090 | 8/1964 | Kanter | 75/130 R |
| 3,306,737 | 2/1967 | Muhlberger | 75/130 AB |
| 3,507,644 | 4/1970 | Coyle | 75/130 R |

*Primary Examiner*—P. D. Rosenberg

*Attorney, Agent, or Firm*—Scrivener, Parker, Scrivener and Clarke

[57] ABSTRACT

A method of treating molten carbon-containing iron to produce a cast iron with a compacted graphite structure comprising adding to the molten iron in a single step a quantity of an alloy containing silicon, magnesium, titanium, calcium and a rare earth, the balance being iron. Preferably, the alloy has the following nominal composition by weight:

30 to 80% Silicon,
2 to 15% Magnesium,
3 to 25% Titanium,
2 to 10% Calcium,
0.05 to 1.0% Cerium and
the Balance Iron.

12 Claims, 3 Drawing Figures

CAST IRON

Figure 1:
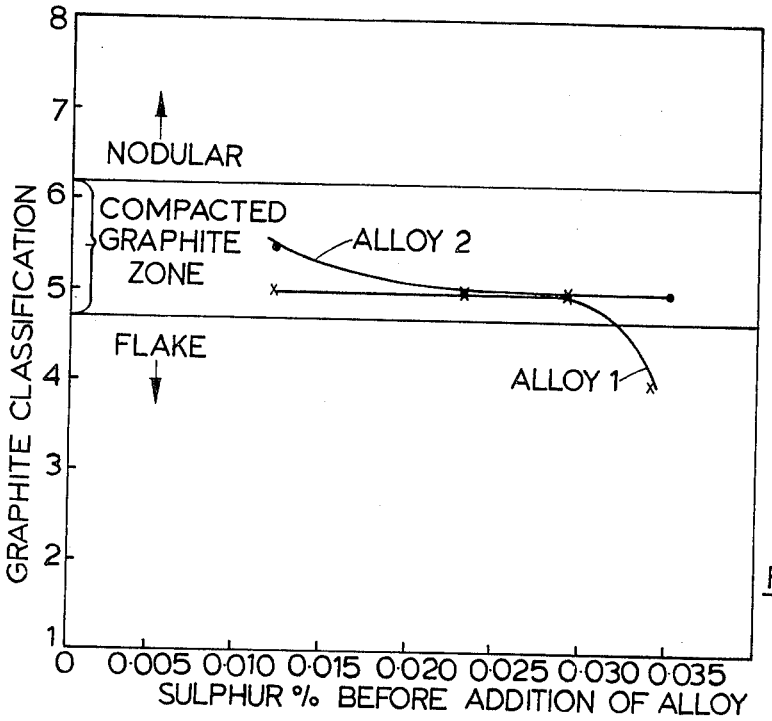

This invention relates to the manufacture of cast iron with compacted graphite.

Compacted graphite is a preferred name given to flake graphite which has become rounded, thickned and shortened compared with the normal elongated flakes commonly found in grey cast irons. This modified form of graphite has become known by various names including 'compacted', 'vermicular', 'quasi-flake', 'aggregate flake', 'chunky', 'stubby', 'up-graded', 'semi-nodular' and 'floccular' graphite.

Most cast irons have elongated flake graphite structures and such irons are comparatively weak and brittle, but have good thermal conductivity and resistance to thermal shock. It is known, however, that it is possible to produce cast irons having a nodular graphite structure and these are ductile and comparatively strong, but they have lower thermal conductivity and in some circumstances poorer resistance to thermal shock. Irons with compacted graphite structures combine the high strength and ductility often associated with nodular graphite irons whilst retaining good thermal conductivity and resistance to thermal shock.

Those skilled in the art of iron founding are aware that compacted graphite structures can be produced by alloying with magnesium but the process is difficult to control because of the very narrow range of magnesium contents required to produce the structure (0.015 to 0.02) percent). Such control is often impracticable and for this reason the process has up to now only had limited commerical use.

Inco and Schelleng (British patent specification No. 1 069 058) who refer to the graphite form as 'vermicular graphite', were able to extend the range of permissible magnesium contents by the addition of 0.15 to 0.5 percent titanium and 0.001 and 0.015 percent rare earth metal added separately to the molten iron. This quantity of titanium is regarded as high, but was claimed to be necessary to cover a wide range of magnesium contents (0.005 to 0.06 percent) whilst avoiding the formation of nodular graphite structures.

Also, we have found that compacted graphite structures can be produced in irons having a magnesium content in the range 0.010 to 0.035 percent, by adding 0.06 to 0.15 percent titanium and a trace of cerium.

The usual way of producing compacted graphite irons in which the main added ingredient is magnesium is to add the magnesium as 5 percent magnesium ferro-silicon containing cerium: the titanium is added either as ferro-titanium or titanium metal in the ladle or as ferro-titanium or titanium-bearing pig iron in the furnace charge. In some cases the cerium is added separately as mischmetall or any other convenient source.

In our earlier British patent specification No. 1,427,445 we disclose and claim a method of treating cast iron which can be used to produce compacted graphite structures in the cast iron without the danger of either having too much titanium present in a low magnesium iron or alternatively, of producing nodular graphite because there is insufficient titanium in the case of a high magnesium iron. Thus, the reliability with which a cast iron is obtained having the required compacted graphite structure despite deviations from the expected values for the amount of metal treated or the sulphur content of the iron is improved. According to the claimed method this is achieved, instead of by adding the ingredients separately, by a single treatment of the iron with an alloy containing silicon, magnesium, titanium, and a rare earth, the balance being iron.

However, we have found that when the sulphur content of the cast iron exceeds about 0.025 to 0.03 percent, the quantity of alloy needed to be added according to our earlier method must be increased. However larger additions of the alloy are undesirable because they lead to the risk of spheroidal graphite formation in any batch of iron in which the initial sulphur content may fall below the level anticipated.

According to the present invention we propose to counter this problem by the addition of calcium to the alloy, which we have found confers upon it the ability, for a given added quantity, to produce compacted graphite in cast irons with a wider range of initial sulphur contents. The invention thus consists in a method of treating molten carbon-containing iron comprising adding to the molten iron in a single step a quantity of an alloy containing silicon, magnesium, titanium, calcium, and a rare earth, the balance being iron.

Preferably, the modified alloy has the following nominal compositions by weight:

Silicon : 30–80%
Magnesium : 2–15%
Titanium : 3–25%
Calcium : 2–10%
Cerium : 0.05–1.0%
Balance substantially iron.

The ratio of Mg:Ti lies between 1:1 and 1:2. The ratio of Mg:Ce lies between 50:1 and 2:1 but is preferably between 50:1 and 10:1. The ratio of Mg:Ca lies between 1:1 and 1:5.

The preferred composition is:

Silicon : 40–60%
Magnesium : 3–6%
Titanium : 5–8%
Calcium : 4–7%
Cerium : 0.1–0.5%

In the production of these irons it is an advantage to inoculate the iron in the way which is conventional for grey cast irons, the inoculant being either a proprietary material or as commercial ferro-silicon. This is particularly useful when the iron is to be cast in thinner sections.

Alloys of the kind described may be produced by the established methods for making ferro-alloys which can involve, amongst other processes, melting together the individual constituents or master alloys, or of forming a bath of molten alloy containing the major constituents and adding it to the minor constituents. Alternatively, the alloys can be made by using the conventional submerged arc process to maufacture a liquid titanium and/or calcium containing ferro-silicon, and then adding magnesium and other desired elements by plunging them below the surface of the molten, alloyed ferro-silicon, followed by stirring to provide adequate alloy uniformity.

Other rare earth elements may be substituted for cerium in whole or in part.

The following is an example of the use of the alloy at several different levels of addition to produce good compacted graphite structures. The alloy composition used was:

Magnesium : 5.05%
Silicon : 47.5%
Calcium : 4.4%
Cerium : 0.23%

Titanium : 8.5%
Balance iron.
The composition of the iron treated was:

| TC% | Si% | S% | Mn% |
|---|---|---|---|
| 3.7 | 1.5 | 0.02 | 0.5 |

Four taps were taken and treated respectively with 1 percent, 1.15 percent, 1.30 percent and 1.50 percent of the alloy and an addition of silicon metal was made in order that the total silicon addition should be kept approximately constant in the final irons. The compositions of the taps were:

| Tap No. | Treatment | TC% | Si% | Mn% | S% | Mg% | Ti% |
|---|---|---|---|---|---|---|---|
| 1 | 1% Alloy Addition | 3.65 | 2.22 | 0.47 | 0.014 | 0.016 | 0.090 |
| 2 | 1.15% Alloy Addition | — | 2.28 | 0.47 | 0.014 | 0.018 | 0.100 |
| 3 | 1.30% Alloy Addition | — | 2.30 | 0.47 | 0.016 | 0.021 | 0.109 |
| 4 | 1.50% Alloy Addition | 3.60 | 2.34 | 0.47 | 0.014 | 0.024 | 0.116 |

From each a 4 inch diameter bar and a 1.2 inch diameter bar were cast. Every one of these had a fullycompacted graphite structure with only occasional graphite nodules which are commonly-found in such irons.

In a second series of tests the advantage of the alloy in treating irons of a range of sulphur contents was demonstrated. Two alloys were used, one alloy No. 1 being an alloy according to our earlier U.S. Pat. No. 1,427,445 which has no calcium content, and the second alloy No. 2 being an alloy according to the present invention which includes calcium. The composition of each alloy was as follows:

| | Alloy No. 1 | Alloy No. 2 |
|---|---|---|
| Silicon % | 41.3 | 44.7 |
| Magnesium % | 5.1 | 4.5 |
| Titanium % | 7.9 | 7.1 |
| Calcium % | — | 6.0 |
| Cerium % | 0.10 | 0.10 |

These alloys were used to treat taps of iron from two melts. The first melt was treated with 1.5 percent alloy addition and the second melt with 1.3 percent alloy addition. Between the taps the sulphur content of each melt was successively increased from about 0.011 percent — 0.035 percent.

The chemical compositions of the taps from the first melt were:

TABLE 1

| Tap No. | Treatment of Melt 1 | TC% | Si% | Mn% | S% | Mg% | Ti% |
|---|---|---|---|---|---|---|---|
| 1 | Melt before alloy treatment | 3.6 | 1.6 | 0.48 | 0.012 | — | — |
| | 1.5% Alloy 1 Addition | 3.64 | 2.19 | 0.48 | 0.011 | 0.026 | 0.109 |
| | 1.5% Alloy 2 Addition | 3.62 | 2.14 | 0.48 | 0.008 | 0.024 | 0.074 |
| 2 | Melt before alloy treatment | 3.6 | 1.6 | 0.48 | 0.023 | — | — |
| | 1.5% Alloy 1 Addition | 3.67 | 2.15 | 0.48 | 0.014 | 0.025 | 0.113 |
| | 1.5% Alloy 2 Addition | 3.67 | 2.17 | 0.48 | 0.012 | 0.027 | 0.097 |
| 3 | Melt before alloy treatment | 3.6 | 1.6 | 0.48 | 0.029 | — | — |
| | 1.5% Alloy 1 Addition | 3.59 | 2.20 | 0.48 | 0.015 | 0.025 | 0.115 |
| | 1.5% Alloy 2 Addition | 3.54 | 2.16 | 0.48 | 0.015 | 0.026 | 0.097 |
| 4 | Metal before alloy treatment | 3.6 | 1.6 | 0.48 | 0.034 | — | — |
| | 1.5% Alloy 1 Addition | 3.65 | 2.15 | 0.48 | 0.011 | 0.025 | 0.122 |
| | 1.5% Alloy 2 Addition | 3.53 | 2.12 | 0.48 | 0.012 | 0.025 | 0.078 |

The chemical composition of the taps from the second melt were:

TABLE 2

| Tap No. | Treatment of Melt 2 | TC% | Si% | Mn% | S% | Mg% | Ti% |
|---|---|---|---|---|---|---|---|
| 1 | Melt before alloy treatment | 3.6 | 1.8 | 0.52 | 0.011 | — | — |
| | 1.3% Alloy 1 Addition | 3.61 | 2.31 | 0.52 | 0.012 | 0.022 | 0.096 |
| | 1.3% Alloy 2 Addition | 3.65 | 2.24 | 0.52 | 0.014 | 0.022 | 0.077 |
| 2 | Melt before alloy treatment | 3.6 | 1.8 | 0.52 | 0.017 | — | — |
| | 1.3% Alloy 1 Addition | 3.61 | 2.25 | 0.52 | 0.019 | 0.023 | 0.097 |
| | 1.3% Alloy 2 Addition | 3.58 | 2.21 | 0.52 | 0.015 | 0.018 | 0.072 |
| 3 | Melt before alloy 3.6 | 1.8 | 0.52 | 0.026 | — | — | |
| | 1.3% Alloy 1 Addition | 3.61 | 2.20 | 0.52 | 0.015 | 0.020 | 0.090 |
| | 1.3% Alloy 2 Addition | 3.63 | 2.18 | 0.52 | 0.015 | 0.019 | 0.065 |
| 4 | Melt before alloy treatment | 3.6 | 1.8 | 0.52 | 0.035 | — | — |
| | 1.3% Alloy 1 Addition | 3.63 | 2.22 | 0.52 | 0.017 | 0.020 | 0.092 |
| | 1.3% Alloy 2 Addition | 3.53 | 2.23 | 0.52 | 0.021 | 0.021 | 0.078 |

From each tap a 4 inch diameter bar, a 1.2 inch diameter bar and a 1.25 inch thick keel-block was cast.

The 4 inch diameter bars and the 1.2 inch diameter bars were examined metallographically and the graphite structure of each was classified using a scale ranging from 1 to 8, the graphite becoming less flake-like and more compact as the numbers increase from 1 to 8, and a fully nodular graphite structure being associated with number 8. The desired compacted graphite structure is designated by numbers 5 or 6.

The results for the bars from the first melt were:

TABLE 3

| Tap No. | Treatment of Melt 1 | 4 in dia. bars graphite classification | 1.2 in dia. bars graphite classification | Base sulphur contents % |
|---|---|---|---|---|
| | 1.5% Alloy 1 | 5 | 5 - 6 | 0.012 |
| 1 | 1.5% Alloy 2 | 5 - 6 | 6 | " |
| | 1.5% Alloy 1 | 5 | 5 | 0.023 |
| 2 | 1.5% Alloy 2 | 5 | 5 - 6 | " |
| | 1.5% Alloy 1 | 5 | 5 | 0.029 |
| 3 | 1.5% Alloy 2 | 5 | 5 - 6 | " |
| | 1.5% Alloy 1 | 4 (Flake) | 4 (Flake) | 0.034 |
| 4 | 1.5% Alloy 2 | 5 | 5 | " |

The results for the bars from the second melt were:

TABLE 4

| Tap No. | Treatment of Melt 2 | 4 in dia. bars graphite classificaton | 1.2 in dia. bars graphite classification | Base sulphur contents % |
|---|---|---|---|---|
| | 1.3% Alloy 1 | 5 | 5 | 0.011 |

TABLE 4-continued

| Tap No. | Treatment of Melt 2 | 4 in dia. bars graphite classificaton | 1.2 in dia. bars graphite classification | Base sulphur contents % |
|---|---|---|---|---|
| 1 | 1.3% Alloy 2 | 5 | 5 | " |
| | 1.3% Alloy 1 | 5 | 5 | 0.017 |
| 2 | 1.3% Alloy 2 | 5 | 5 | " |
| | 1.3% Alloy 1 | 4 (Flake) | 5 | 0.026 |
| 3 | 1.3% Alloy 2 | 5 | 5 | " |
| | 1.3% Alloy 1 | 2 (Flake) | 3 (Flake) | 0.035 |
| 4 | 1.3% Alloy 2 | 5 | 5 | " |

Figure 2:
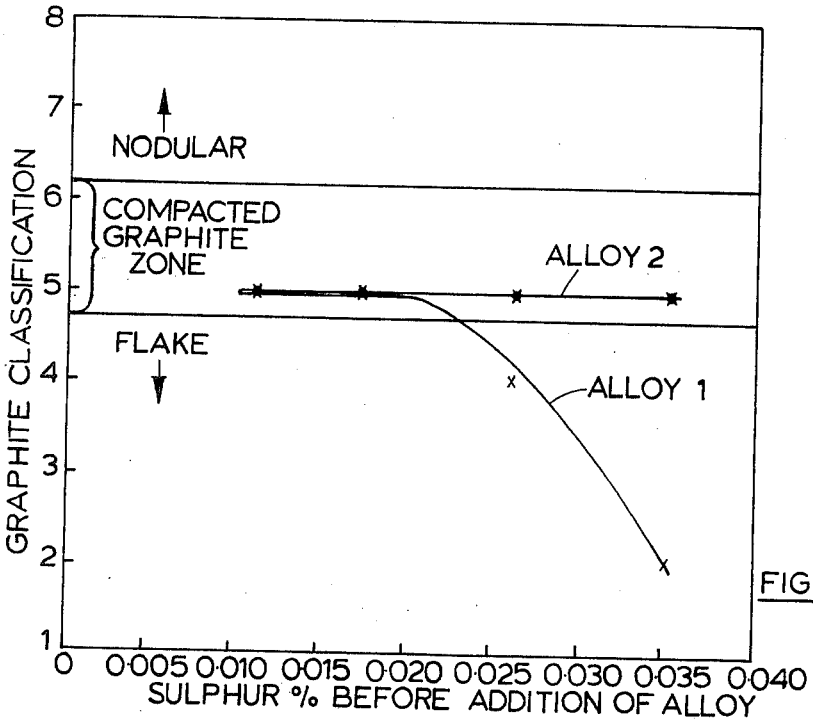

The results for the 4 inch diameter bars from both melts are also shown in graph form in the accompanying drawings in which FIG. 1 relates to the bars cast from the first melt with a 1.5 percent alloy addition and FIG. 2 relates to the bars cast from the second melt with a 1.3 percent alloy addition. The curves relating to the bars treated with alloy 1 and alloy 2 are marked accordingly on the graphs.

Both FIGS. 1 and 2 clearly demonstrate that the calcium content of alloy No. 2 helps to suppress the formation of flake graphite so as to give compacted graphite at sulphur contents in excess of about 0.025 percent.

The mechanical properties of test bars cut from the 1.25 inch thick keel-blocks were measured and the results for the bars from the first melt were:

TABLE 5

| Tap No. | Treatment of Melt 1 | Proof Stress tons/in$^2$ 0.1% | 0.25 | 0.5% | Tensile Strength tons/in$^2$ | Elongation Per Cent | Hardness HB 10/3000 |
|---|---|---|---|---|---|---|---|
| | 1.5% Alloy 1 | 18.0 | 19.6 | 21.7 | 31.1 | 4 | 204 |
| 1 | 1.5% Alloy 2 | 18.2 | 19.8 | 21.6 | 31.6 | 4 | 204 |
| | 1.5% Alloy 1 | 17.0 | 18.6 | 20.5 | 28.5 | 4 | 192 |
| 2 | 1.5% Alloy 2 | 17.3 | 18.9 | 20.6 | 29.1 | 3.5 | 197 |
| | 1.5% Alloy 1 | 17.0 | 18.5 | 20.4 | 28.0 | 4 | 189 |
| 3 | 1.5% Alloy 2 | 17.4 | 19.0 | 20.8 | 28.9 | 3.5 | 190 |
| | 1.5% Alloy 1 | — | — | 6.4 | 19.8 | 2 | 157 |
| 4 | 1.5% Alloy 2 | 15.5 | 16.9 | 18.4 | 23.7 | 3 | 170 |

The results for the bars from the second melt were:

TABLE 6

| Tap No. | Treatment-/tons/in$^2$ of Melt 2 | Proof Stress Strength 0.1% | 0.2% | 0.5% | Tensile Per Cent tons/in$^2$ | Elongation HB Cent | Hardness 10/3000 |
|---|---|---|---|---|---|---|---|
| | 1.3% Alloy 1 | 17.2 | 18.9 | 21.0 | 27.7 | 3 | 195 |
| 1 | 1.3% Alloy 2 | 17.8 | 19.4 | 21.3 | 28.7 | 3.5 | 197 |
| | 1.3% Alloy 1 | 16.2 | 17.8 | 19.6 | 25.0 | 3 | 187 |
| 2 | 1.3% Alloy 2 | 16.6 | 17.6 | 19.4 | 24.6 | 3 | 183 |
| | 1.3% Alloy 1 | 14.3 | 15.6 | 17.1 | 17.4 | 1 | 163 |
| 3 | 1.3% Alloy 2 | 15.3 | 17.1 | 18.9 | 22.1 | 2.5 | 169 |
| | 1.3% Alloy 1 | 6.3 | 7.4 | 8.8 | 9.5 | 1 | 143 |
| 4 | Alloy 2 | 14.7 | 16.5 | 18.1 | 21.5 | 2 | 168 |

The results of these measurements demonstrate that alloy No. 2 has no deliterious effect on mechanical properties as compared with alloy No. 1.

As demonstrated above, the calcium content of the alloy according to the invention broadens the range of sulphur contents over which the alloy can be used to produce cast iron with a compacted graphite structure. However, it has also been observed that the calcium content broadens the range of magnesium contents over which compacted graphite structures can be produced. This latter effect has been demonstrated using an alloy as follows:

Silicon % : 50.05
Magnesium % : 5.41
Titanium % : 8.15
Calcium % : 5.48
Cerium % : 0.43

Figure 3:
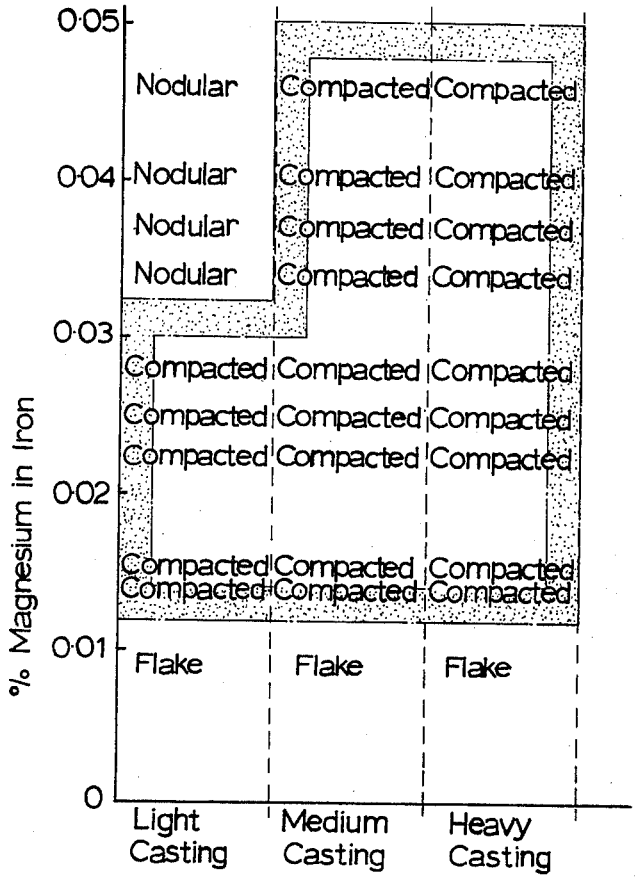

This alloy was used to treat a series of taps of iron which differed only in their magnesium content, the basic melt having a carbon equivalent TC of 4.3% and a sulphur content of 0.015%. Three types of casting were made from each tap and the graphite structure of each determined as before. The three types of casting were a light casting in the form of an A.F.S. microcoupon sample, a medium casting in the form of a keel block, and a heavier casting in the form of a 5 inch diameter bar. The results are set out in graph form in FIG. 3 of the accompanying drawings. This shows that cast iron with a compacted graphite structure was obtained over a range from 0.01 to 0.05% magnesium.

We claim:

1. A method of treating molten carbon-containing iron to produce a cast iron with a compacted graphite structure comprising adding to the molten iron in a single step a quantity of an alloy containing silicon, magnesium, titanium, calcium and a rare earth, the balance being iron.

2. A method according to claim 1 in which the alloy has the following nominal composition by weight:

Silicon : 30–80%
Magnesium : 2–15%
Titanium : 3–25%
Calcium : 2–10%
Cerium : 0.05–1.0%
Balance : Iron

3. A method according to claim 2 in which the ratio of magnesium to titanium in the alloy is between 1:1 and 1:2 by weight.

4. A method according to claim 2 in which the ratio of magnesium to cerium is between 50:1 and 2:1 by weight.

5. A method according to claim 4 in which the ratio of magnesium to cerium is between 50:1 and 10:1 by weight.

6. A method according to claim 2 in which the ratio of magnesium to calcium is between 1:1 and 1:5 by weight.

7. A method according to claim 2 in which the alloy has the following nominal composition by weight:

Silicon : 40–60%
Magnesium : 3–6%
Titanium : 5–8%
Calcium : 4–7%
Cerium : 0.1–0.5%
Balance : Iron

8. A method according to claim 1 in which the alloy is added to the extent of 0.6% to 1.8% by weight of the molten iron.

9. A method according to claim 1 in which, after the additon of the alloy, the iron is treated with an inoculant.

10. A method according to claim 9 in which the inoculant is ferrosilicon.

11. An alloy for use in the method according to claim 2 the alloy being of the following nominal composition by weight:

Silicon : 30–80%
Magnesium : 2–15%
Titanium : 3–25%
Calcium : 2–10%
Cerium : 0.05–1.0%
Balance : Iron 12. An alloy for use in the method according to claim 7 the alloy being of the following nominal composition by weight:

Silicon : 40–60%
Magnesium : 3–6%
Titanium : 5–8%
Calcium : 4–7%
Cerium : 0.1–0.5%
Balance : Iron.

* * * * *